US008128191B2

(12) United States Patent
Kuwahara et al.

(10) Patent No.: US 8,128,191 B2
(45) Date of Patent: Mar. 6, 2012

(54) MAINTENANCE METHOD FOR DISCHARGING HEAD, MAINTENANCE DEVICE FOR DISCHARGING HEAD, DROPLET DISCHARGING APPARATUS, DISCHARGING HEAD, AND COMPUTER PROGRAM

(75) Inventors: Soichi Kuwahara, Kanagawa (JP); Kazuyasu Takenaka, Tokyo (JP)

(73) Assignee: Sony Corporation, Tokyo (JP)

( * ) Notice: Subject to any disclaimer, the term of this patent is extended or adjusted under 35 U.S.C. 154(b) by 92 days.

(21) Appl. No.: 12/221,046

(22) Filed: Jul. 30, 2008

(65) Prior Publication Data

US 2009/0051719 A1 Feb. 26, 2009

(30) Foreign Application Priority Data

Aug. 26, 2007 (JP) ..... P2007-219138

(51) Int. Cl.
*B41J 2/165* (2006.01)

(52) U.S. Cl. ..... 347/23

(58) Field of Classification Search ..... 347/22–24, 347/29, 30, 32, 35, 10, 92
See application file for complete search history.

(56) References Cited

U.S. PATENT DOCUMENTS

| | | | | | |
|---|---|---|---|---|---|
| 5,530,462 | A * | 6/1996 | Takahashi et al. | ..... | 347/23 |
| 5,805,180 | A * | 9/1998 | Ebisawa et al. | ..... | 347/23 |
| 6,257,696 | B1 * | 7/2001 | Nakamura | ..... | 347/30 |
| 6,557,971 | B1 * | 5/2003 | Vega et al. | ..... | 347/35 |
| 6,739,693 | B1 * | 5/2004 | Ferringer | ..... | 347/22 |

FOREIGN PATENT DOCUMENTS

| | | | |
|---|---|---|---|
| JP | 11-157103 | | 6/1999 |
| JP | 2001-038890 | | 2/2001 |
| JP | 2001-180005 | | 7/2001 |
| JP | 2004-167839 | * | 6/2004 |
| JP | 2004-216597 | * | 8/2004 |
| JP | 2004-216598 | * | 8/2004 |
| JP | 2005-262523 | | 9/2005 |
| JP | 2006-116853 | | 5/2006 |

* cited by examiner

*Primary Examiner* — Kristal Feggins
(74) *Attorney, Agent, or Firm* — Robert J. Depke; Rockey, Depke & Lyons, LLC

(57) ABSTRACT

A maintenance method is provided for a discharging head in which multiple discharging portions are arranged in line. The maintenance method includes the steps of performing an operation of continuously discharging droplets from one discharging portion or a plurality of unadjacent discharging portions, and repeating the operation for one discharging portion or a plurality of discharging portions adjacent to the previous discharging portion or the previous discharging portions in a predetermined direction.

15 Claims, 19 Drawing Sheets

INK INFLOW DIRECTION

DROPLET DISCHARGING DIRECTION

MAINTENANCE METHOD FOR DISCHARGING HEAD, MAINTENANCE DEVICE FOR DISCHARGING HEAD, DROPLET DISCHARGING APPARATUS, DISCHARGING HEAD, AND COMPUTER PROGRAM

CROSS REFERENCES TO RELATED APPLICATIONS

The present invention contains subject matter related to Japanese Patent Application JP 2007-219138 filed in the Japanese Patent Office on Aug. 26, 2007, the entire contents of which are incorporated herein by reference.

BACKGROUND OF THE INVENTION

1. Field of the Invention

The present invention described in this specification relates to a maintenance technology for a discharging head in which multiple droplet discharging portions are arranged in line, and more particularly, to a maintenance technology suited to remove foreign substances and bubbles from discharging portions and a liquid channel. The present invention has aspects as a maintenance method for a discharging head, a maintenance device for a discharging head, a droplet discharging apparatus, and a computer program.

2. Description of the Related Art

A description will now be given of the related art in which fluid to be discharged is ink, that is, a droplet discharging apparatus is an inkjet printer.

FIGS. 1A and 1B are schematic views of one discharging portion in an inkjet head serving as a device for discharging ink droplets.

FIG. 1A is a sectional side view of a discharging portion 1, and FIG. 1B is a schematic view of the discharging portion 1, as viewed in a discharging direction of an ink droplet 3 (a nozzle sheet 5 is removed so that the contents can be viewed easily). The ink droplet 3 is discharged from a discharging port (hereinafter also referred to as a nozzle) 7 by generating a bubble 11 by heat from a heater 9 provided below the nozzle 7. A liquid chamber 13 is surrounded by a partition 15.

FIG. 2 is a structural view of an inkjet head 21 in which a plurality of discharging portions 1 are arranged in line, as viewed in the discharging direction of ink droplets 3. In FIG. 2, the nozzle sheet 5 is also not shown.

A foreign substance 23 and a bubble 25 sometimes enter the nozzle 7 and the liquid chamber 13, as shown in FIG. 3. The foreign substance 23 and the bubble 25 adversely affect the operation of discharging ink droplets, and cause curved discharging and undischarging.

SUMMARY OF THE INVENTION

In the related art, the foreign substance 23 and the bubble 25 are pushed out together with ink droplets 3 from the nozzles 7 by applying pressure to ink in the channel, or are sucked from a front side of the nozzle sheet 5. In the present circumstances, however, it is difficult to remove the foreign substance 23 or the bubble 25 when the size of the foreign substance 23 is larger than the bore of the nozzle 7 or when the foreign substance 23 or the bubble 25 is caught in the entrance or wall of the liquid chamber.

Further, when application of pressure or suction is frequently performed, a large amount of ink is consumed. Therefore, the increase in operating cost has been pointed out.

Accordingly, the present inventor proposes a maintenance method that can remove the influence of a foreign substance and a bubble from a discharging head including multiple discharging portions arranged in line, without performing application of pressure or suction.

In other words, the present inventor proposes a method including the steps of performing an operation of continuously discharging droplets from one discharging portion or a plurality of unadjacent discharging portions; and repeating the operation for one discharging portion or a plurality of discharging portions adjacent to the previous discharging portion or the previous discharging portions in a predetermined direction.

By repeating the operation of continuously discharging droplets from one discharging portion while shifting the continuous discharging position one by one in the predetermined direction, a foreign substance or a bubble caught in a liquid chamber or the like can be collected to an end of the head that is not relevant to discharging of droplets.

DESCRIPTION OF THE PREFERRED EMBODIMENTS

A technique according to embodiments of the present invention will be described below with reference to an inkjet printer as an example.

Well-known or publicly known technologies in the technical field of the present invention are applied to portions that are not particularly shown or described in this specification.

Embodiments that will be described below are just exemplary embodiments of the present invention, and the present invention is not limited thereto.

A: EMBODIMENT

A-1: Example of System

Figure 1A:
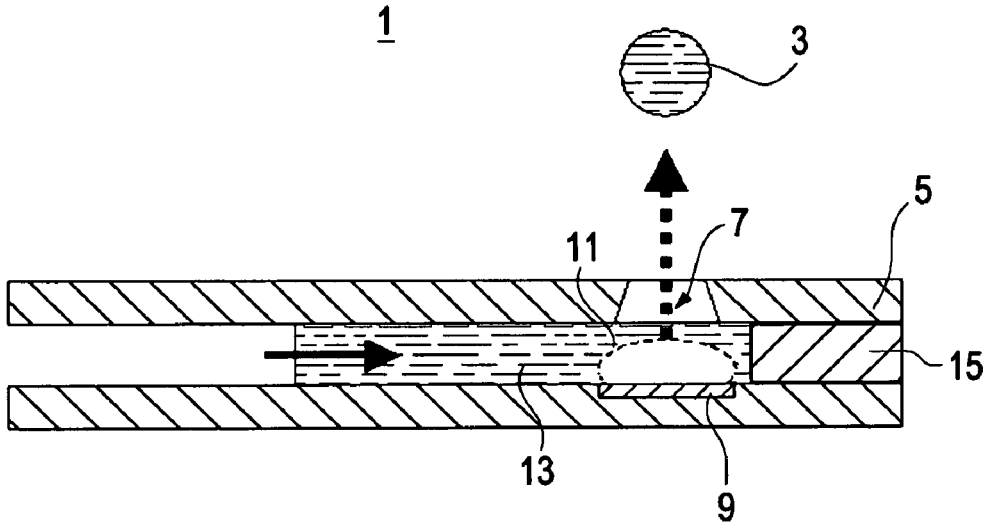
FIGS. 1A and 1B show a structure of a discharging portion that constitutes an inkjet head.
Figure 1B:
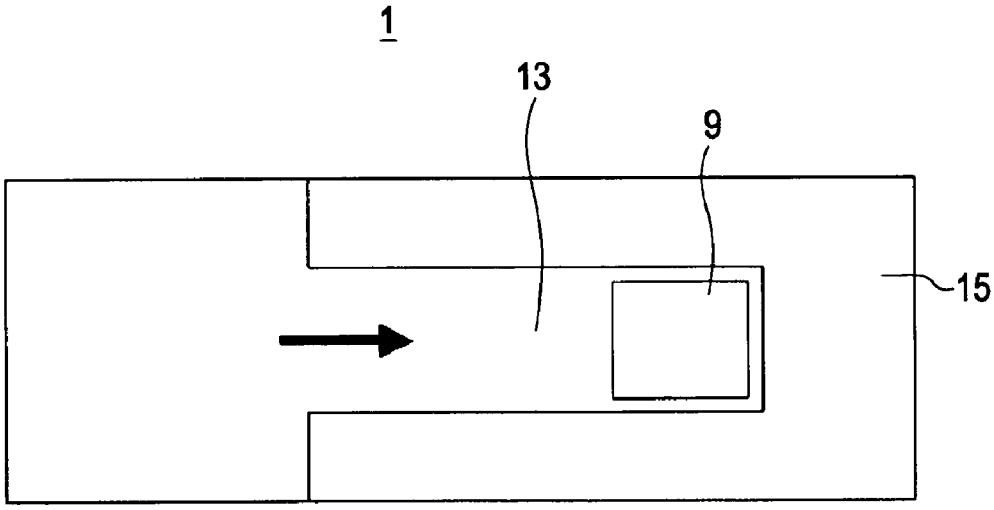
Figure 2:
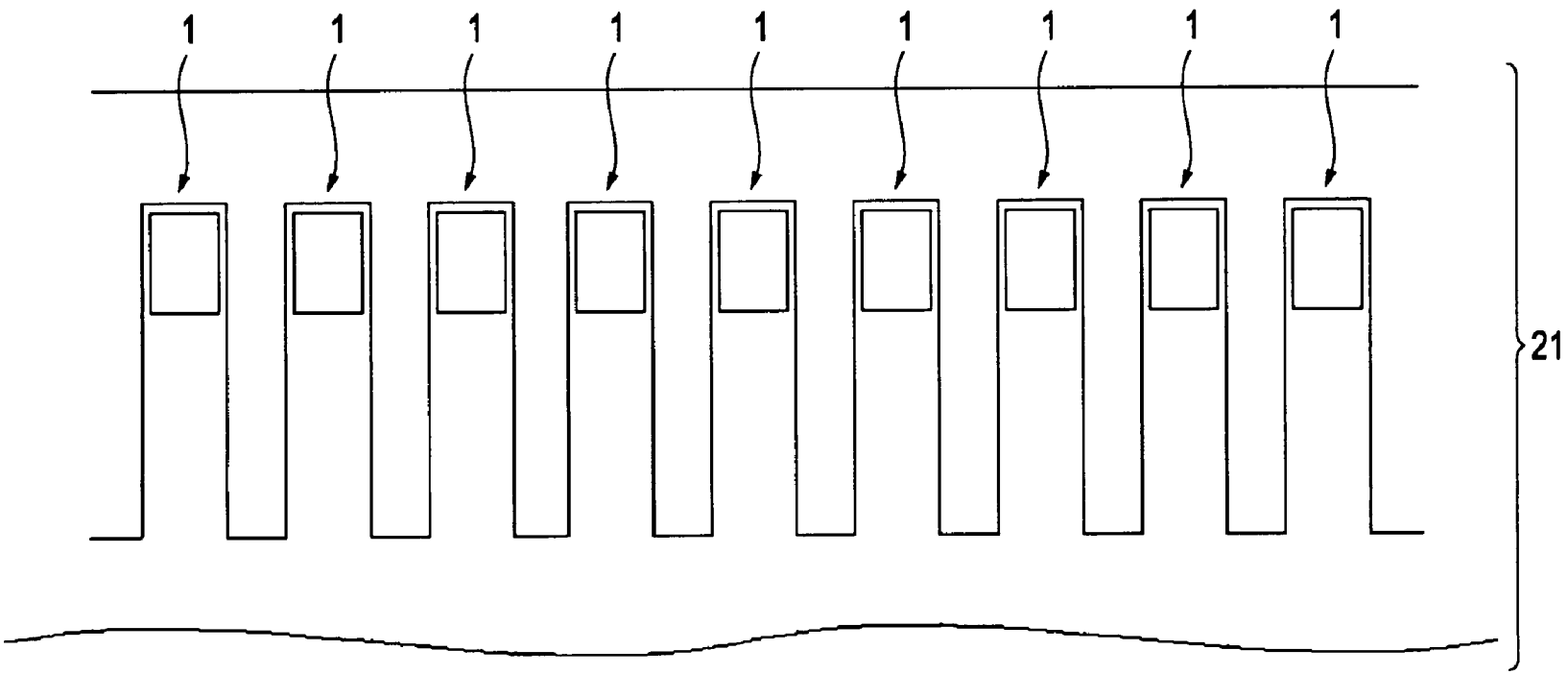
FIG. 2 shows an example of a structure of the inkjet head.
Figure 3:
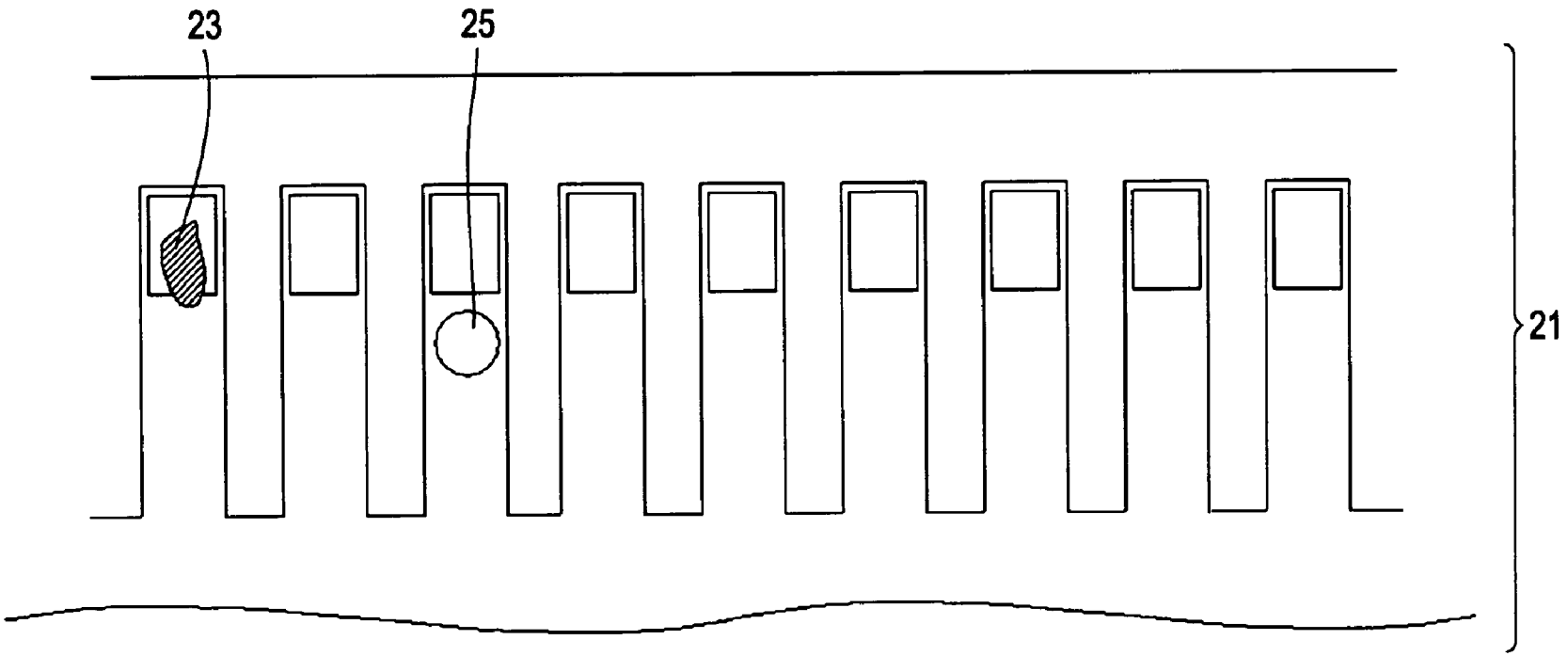
FIG. 3 shows a state in which a foreign substance and a bubble lodge in a nozzle and a liquid chamber.
Figure 4:
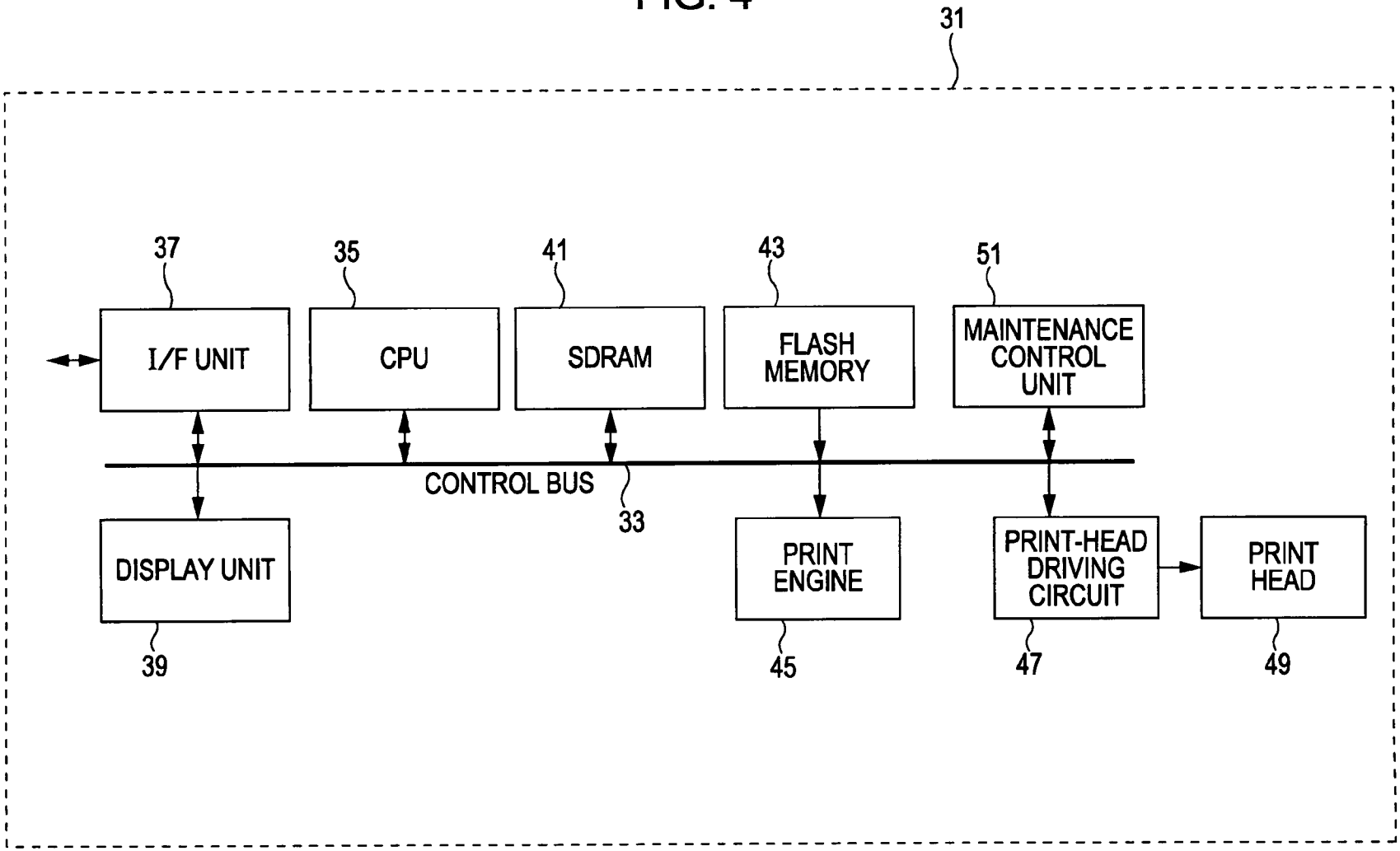
FIG. 4 is a functional block diagram of a printing apparatus.

FIG. 4 is a functional block diagram of an inkjet printer 31 according to an embodiment.

The inkjet printer 31 shown in FIG. 4 principally includes a control bus 33, a CPU 35, an interface unit 37, a display unit 39, an SDRAM 41, a flash memory 43, a print engine 45, a print-head driving circuit 47, a print head 49, and a maintenance control unit 51.

The CPU 35 is a control unit that controls the operations of components of the system according to a program.

The interface unit 37 is a circuit device that exchanges various data with an external apparatus. For example, an Ethernet (Registered Trademark) interface, a USB interface, a wireless USB interface, an IrDA interface, an infrared remote-control interface, and a Bluetooth interface are mounted in the interface unit 37.

Alternatively, a card reader device for reading and writing data from and into an external storage medium may be used as the interface unit 37. By mounting the interface unit 37, image data signals can be directly read out from various storage media such as a memory stick, a smart media card, a PC card, a CompactFlash (Registered Trademark) card, and an SD card. In other words, the interface unit 37 allows printing to be directly performed, not via a personal computer.

The display unit 39 is a display device mounted to display, on a screen, information about selection and confirmation of an image to be printed, confirmation of the contents of operation, and status of operation, etc. For example, an LCD panel is used as the display unit 39. Alternatively, other simple display devices (for example, a display device in which LEDs are arranged in a matrix, and a segment display device) may be used.

The SDRAM 41 is a semiconductor memory that constitutes a spooler. The SDRAM 41 is used to temporarily hold image data signals received or input from an external apparatus and an external storage medium via the interface unit 37.

Image data signals in the spooler are held by cyclic buffering. In other words, the latest image data signal is recorded in an image data area received or input earliest. This can eliminate the trouble of inputting the same image data signal again even when reprinting the same image.

The flash memory 43 serves as a region where firmware is stored, and is formed by a nonvolatile semiconductor memory.

The print engine 45 is a mechanical operating device that cooperates with the print head 49. According to control data given from the CPU 35, the print engine 45 carries out feeding of plain paper or a roll of paper, feeding of an ink ribbon, and other mechanical operations.

The print-head driving circuit 47 substantially drives heaters 9 corresponding to discharging portions 1, which constitute the print head 49, according to control data from the CPU 35. To the print-head driving circuit 47, an image data signal (DATA) read out as an object to be printed from the SDRAM 41, a strobe signal (STROBE) for controlling the time of current supply to the heaters 7, a clock signal (CLOCK) serving as a basic signal for printing, a latch signal (LATCH) for latching the image data signal, and so on are input.

The print head 49 is an image forming device in which discharging portions 1 for discharging ink droplets are arranged in a line along an ink channel. In this embodiment, the print head 49 is a so-called line type print head in which the width of the line of the discharging portions 1 used for image printing is larger than the paper width. Alternatively, the print head 49 is also effective for a print head that is driven to reciprocate in the paper width direction by a serial driving method.

In this embodiment, the print head 49 is capable of color printing. Therefore, one or a plurality of lines of discharging portions 1 are provided for each of the colors, yellow (Y), magenta (M), cyan (C), and black (K).

The maintenance control unit 51 is a circuit device serving as a maintenance function proposed by the present inventor. Therefore, the maintenance control unit 51 can also be realized as one program to be executed in the CPU 35.

The principal function of the maintenance control unit 51 is to perform continuous discharging operation while shifting the continuous discharging position in a predetermined direction one by one from one discharging portion 1 or a plurality of discrete discharging portions 1 before printing and in a maintenance mode.

This continuous discharging operation is effective in removing the influences of foreign substances and bubbles with a small consumption of ink, unlike the operation of applying pressure performed in the related art.

A specific driving method will be described below.

A-2: Specific Example of Continuous Discharging Operation

A: Movement of Foreign Substance due to Shifting of Continuous Discharging Position in One Direction With reference to FIG. 5, a description will be given of how a foreign substance or the like in a discharging portion can be moved by shifting the position, where ink droplets are continuously discharged, one by one in the predetermined direction.

Herein, a case in which a foreign substance 23 exists in a discharging portion 1*a* will be given as an example. When several tens to several hundreds of ink droplets are continuously discharged from a discharging portion 1*b* provided on the right side of the discharging portion 1*a*, flows of ink drawn from other discharging portions on both sides of and near the discharging portion 1*b* are formed in the discharging portion 1*b* by consumption of ink. By these ink flows, the foreign substance 23 in the discharging portion 1*a* is moved to be drawn into the discharging portion 1*b*.

Next, when several tens to several hundreds of ink droplets are continuously discharged from a discharging portion 1*c* provided on the right side of the discharging portion 1*b*, flows of ink drawn from other discharging portions on both sides of and near the discharging portion 1*c* are formed in the discharging portion 1*c* by consumption of ink. By these ink flows, the foreign substance 23 in the discharging portion 1*b* is moved to be drawn into the discharging portion 1*c*.

By these operations, the foreign substance 23 moves from the discharging portion 1*a* to the next discharging portion 1*c* but one on the right side.

Subsequently, similar continuous discharging is repeated by sequentially shifting the continuous discharging position rightward to discharging portions 1*d*, 1*e*, 1*f*, 1*g*, 1*h*, 1*i*, . . . . Consequently, the foreign substance 23 can also be moved to the discharging portions 1*d*, 1*e*, 1*f*, 1*g*, 1*h*, 1*i*, . . . .

b: Example of Print Head and Example of Driving Operation

Examples of print heads suited to move a foreign substance by shifting the continuous discharging position in one direction will be described below.

(i) First Specific Example

Figure 6:
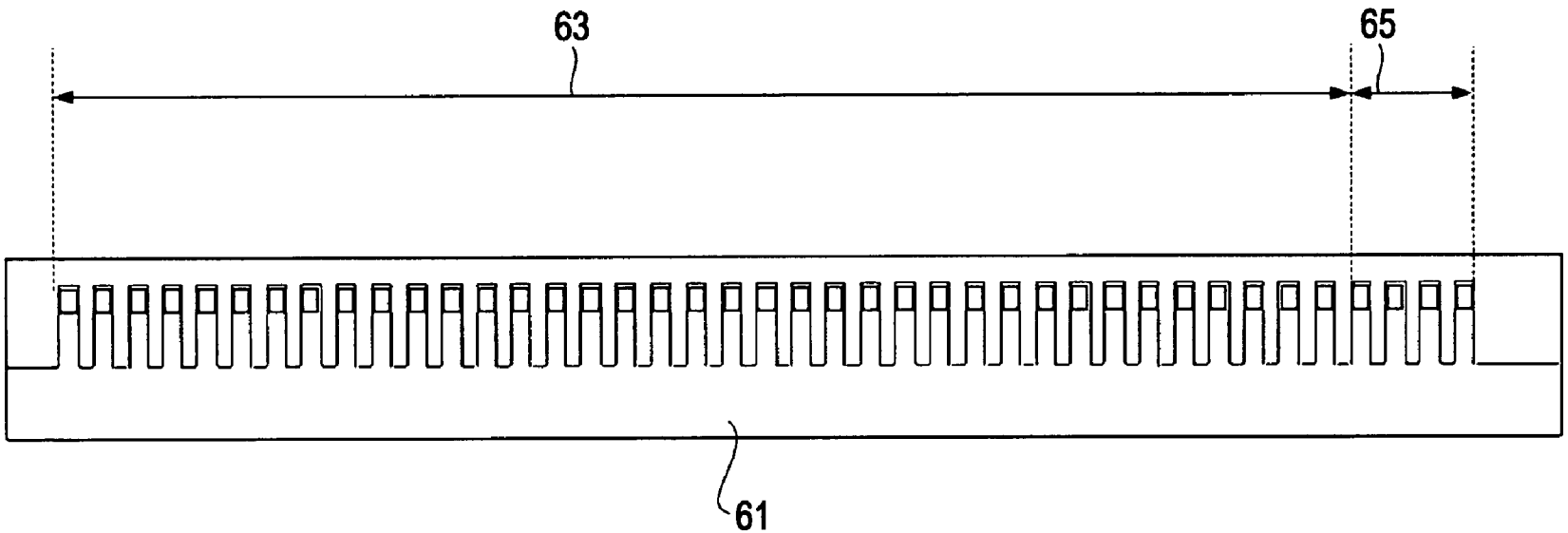
FIG. 6 shows an example of a print head.

FIG. 6 shows a first specific example of a print head. In a print head 61 shown in FIG. 6, a foreign-substance trap region 65 in which a moved foreign substance is trapped is provided at one end (in the shift direction of the continuous discharging position) of a region used for printing (print region 63).

In the print head 61 having this structure, a foreign substance 23 existing in the print region 63 can be moved to the foreign-substance trap region 65 by shifting the discharging portion 1, which continuously discharges several tens to several hundreds of ink droplets, one by one toward the foreign-substance trap region 65. When printing is carried out only with the print region 63 in this state, a print can be obtained without any influence of the foreign substance.

(ii) Second Specific Example

In the above-described print head 61 (first specific example), when printing is frequently repeated in a portion of the print region 63 near the foreign-substance trap region 65, conversely, the foreign substance 23 may be drawn from the foreign-substance trap region 65 into the print region 63. This may adversely affect a print result.

Figure 7:
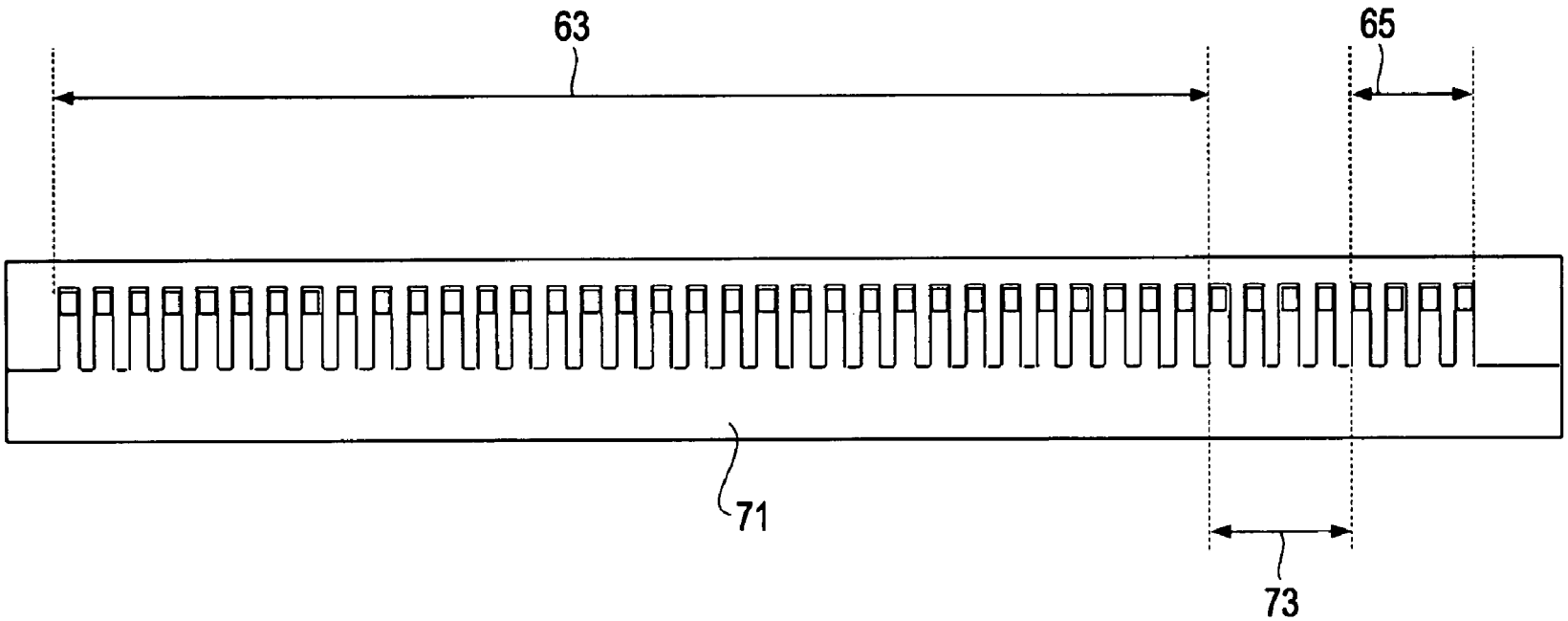
FIG. 7 shows another example of a print head.

Accordingly, FIG. 7 shows a second specific example of a print head. In a print head 71 shown in FIG. 7, a foreign-substance trap region 65 in which a moved foreign substance is trapped, and a barrier region 73 that hinders return of the foreign substance into a region used for printing (print region 63) are provided at one end (in the shift direction of the continuous discharging position) of the print region 63.

In the print head 71 having this structure, a foreign substance 23 existing in the print region 63 can also be moved to the foreign-substance trap region 65 by shifting the discharging portion 1, which continuously discharges several tens to several hundreds of ink droplets, one by one toward the foreign-substance trap region 65.

When printing is carried out only with the print region 63 in this state, a print can be obtained without any influence of the foreign substance. Moreover, a region corresponding to several discharging portions that are not used for printing (that is, the barrier region 73) is provided between the end of the print region 63 and the foreign-substance trap region 65 in this example. Therefore, the possibility that the influence of discharging in the print region 63 on the foreign-substance trap region 65 can be reduced.

In other words, it is possible to prevent the foreign substance from being drawn out from the foreign-substance trap region 65 and returning into the print region 63. Therefore, the image quality obtained in the second specific example is higher than in the first specific example.

(iii) Third Specific Example

It is not always sufficient to perform the above-described operation of controlling movement of the foreign substance by shifting the continuous discharging position in one direction only once. While all foreign substances can, of course, be moved to the foreign-substance trap region 65 only one movement control operation, there is a possibility that all foreign substances will not be collected into the foreign-substance trap region 65. Therefore, it is efficient to repeat this operation several times.

When the number of nozzles used for printing is large in the print head, an area where a foreign substance or bubble exists is wide. For example, a foreign substance or bubble may exist at an end opposite the foreign-substance trap region 65.

Figure 8:
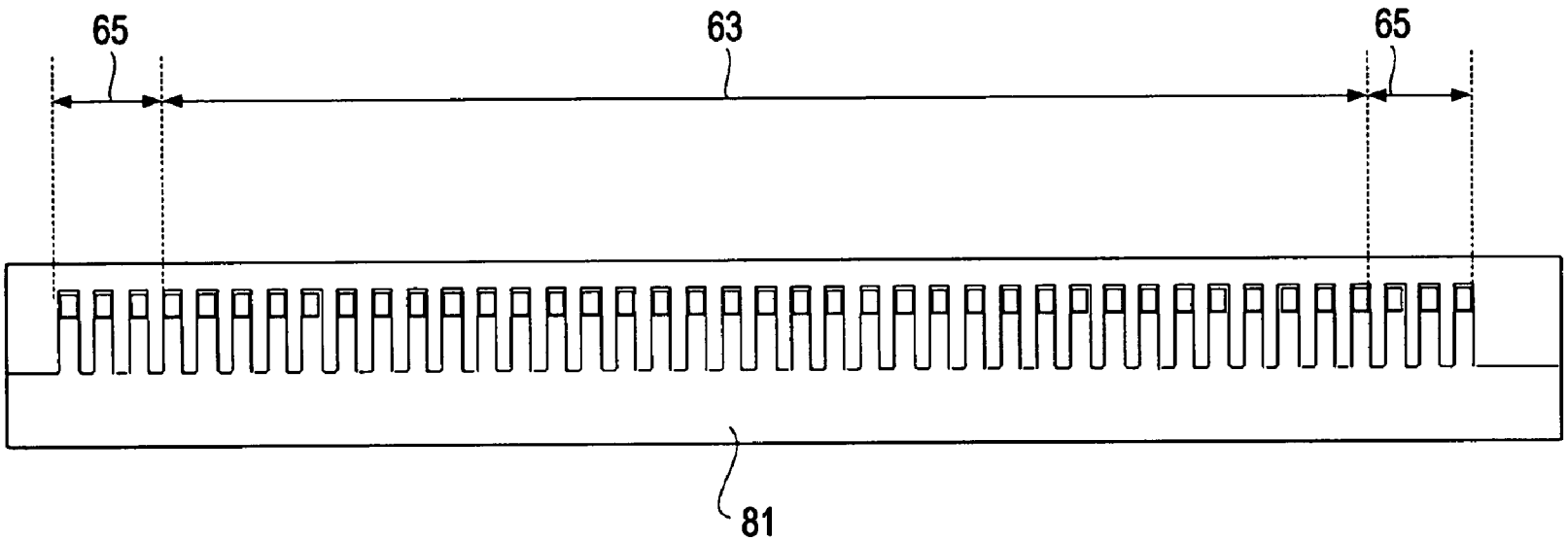
FIG. 8 shows a further example of a print head.
Figure 9:
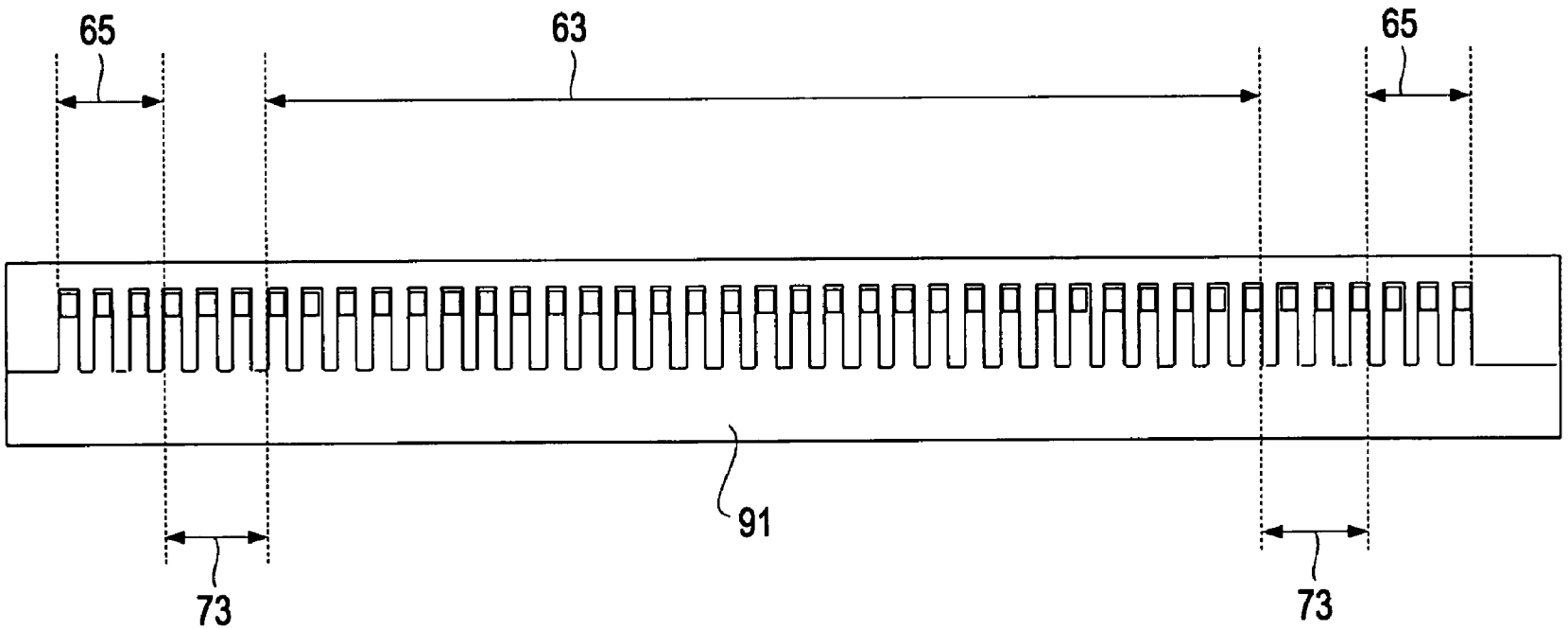
FIG. 9 shows a further example of a print head.

In this case, the discharging portions need to be driven many times so as to move the foreign substance or bubble to the foreign-substance trap region 65, and this takes much time. Accordingly, a foreign-substance trap region 65 can be provided at each end of a print region 63, as in a print head 81 shown in FIG. 8, or a barrier region 73 can be provided at each end of a print region 63, as in a print head 91 shown in FIG. 9.

(iv) Fourth Specific Example

The method for shifting the continuous discharging position one by one in one direction so as to move the foreign substance is effective, but takes too much time.

Accordingly, a method of simultaneously performing continuous discharging in a plurality of unadjacent discharging portions and shifting the continuous discharging portions one by one in one direction is proposed.

Figure 10:
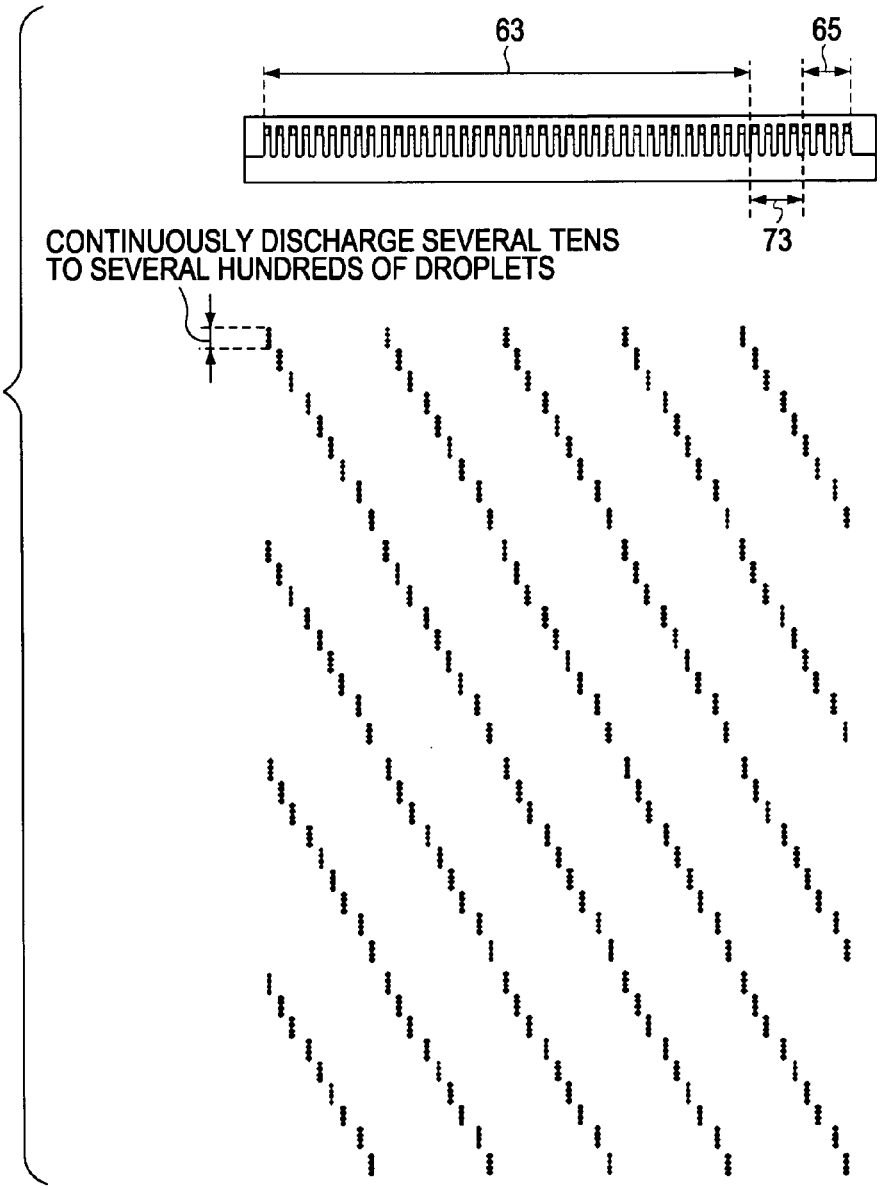
FIG. 10 shows an example of a discharging pattern.

FIG. 10 shows an example of a discharging pattern. This pattern shown in FIG. 10 appears when ink droplets are actually discharged onto print paper. In actuality, ink droplets are discharged into an idle-discharging recovery portion provided in the printing apparatus.

Figure 11:
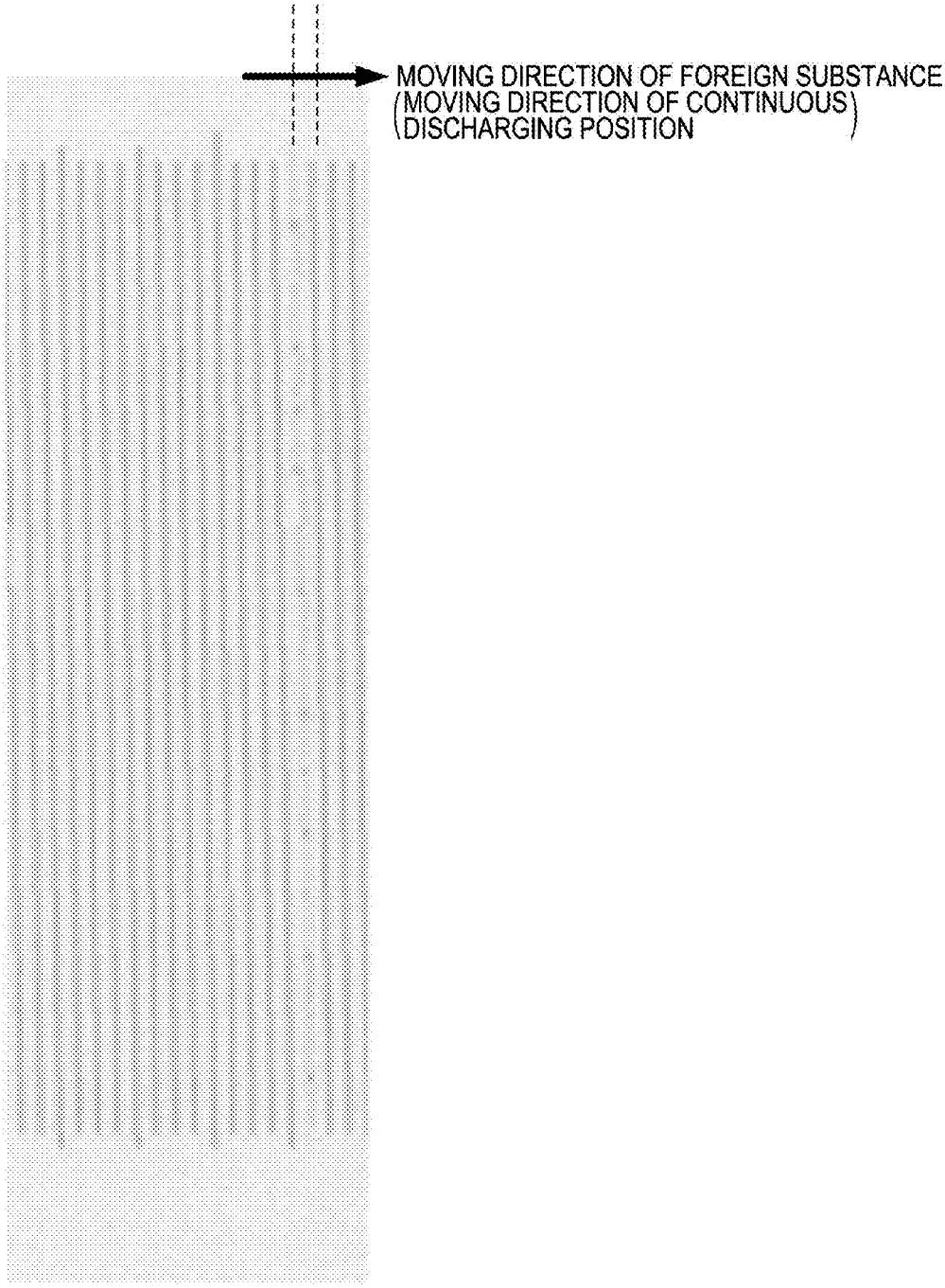
FIG. 11 explains an example of a moving manner of a foreign substance.

FIG. 11 shows a state in which a foreign substance moves in the discharging pattern shown in FIG. 10. In FIG. 11, the position of the foreign substance appears as a discharging defect. This pattern reveals that the position of the foreign substance moves with time.

Figure 12:
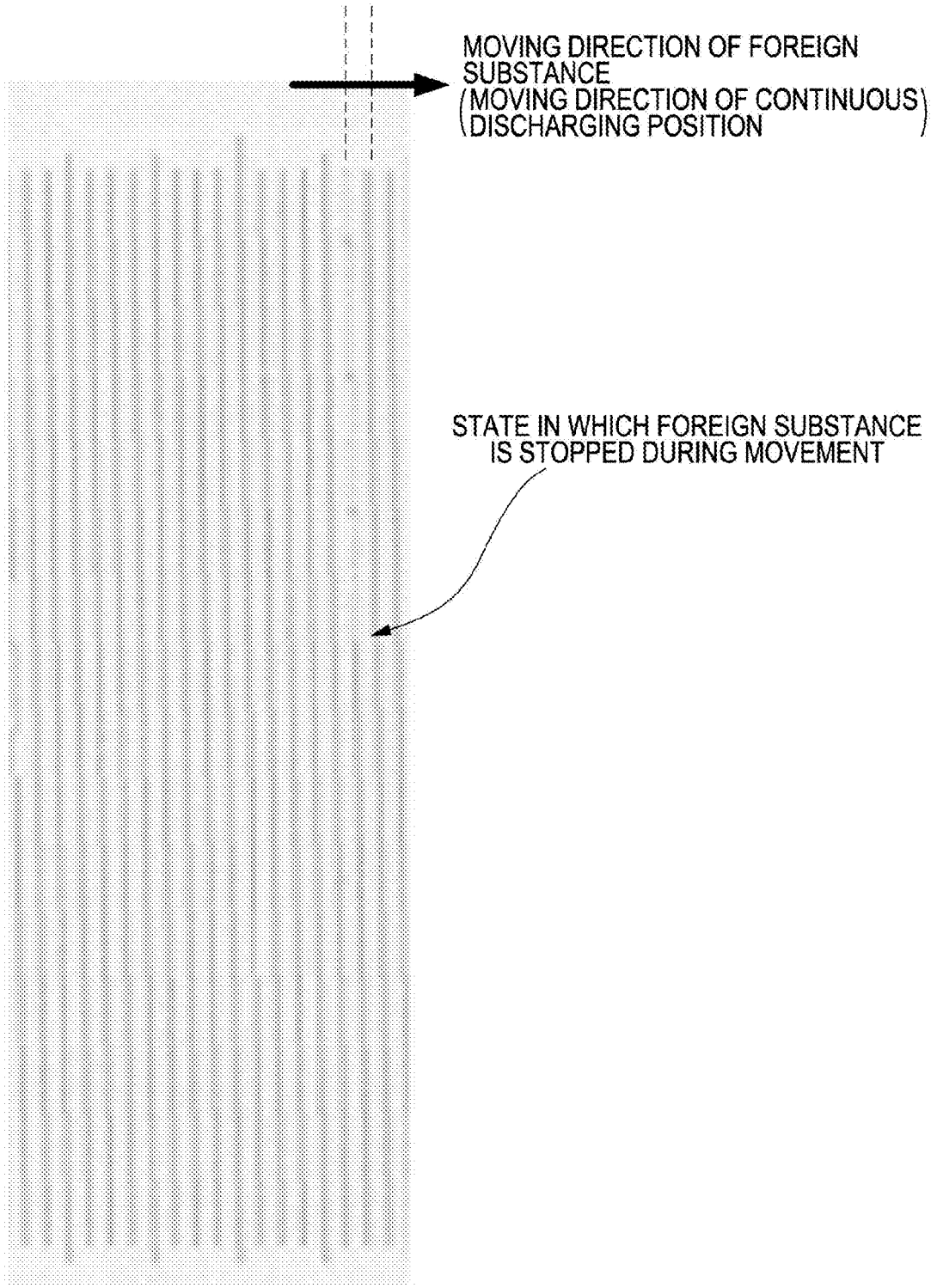
FIG. 12 explains another example of a moving manner of a foreign substance.

A foreign substance sometimes lodges during movement. An arrow in FIG. 12 shows a state in which a foreign substance stops during movement. Since the foreign substance stops, a discharging defect is not found below the position shown by the arrow in FIG. 12.

In actual use, there is a possibility that a foreign substance will not smoothly move in the print head.

Figure 13:
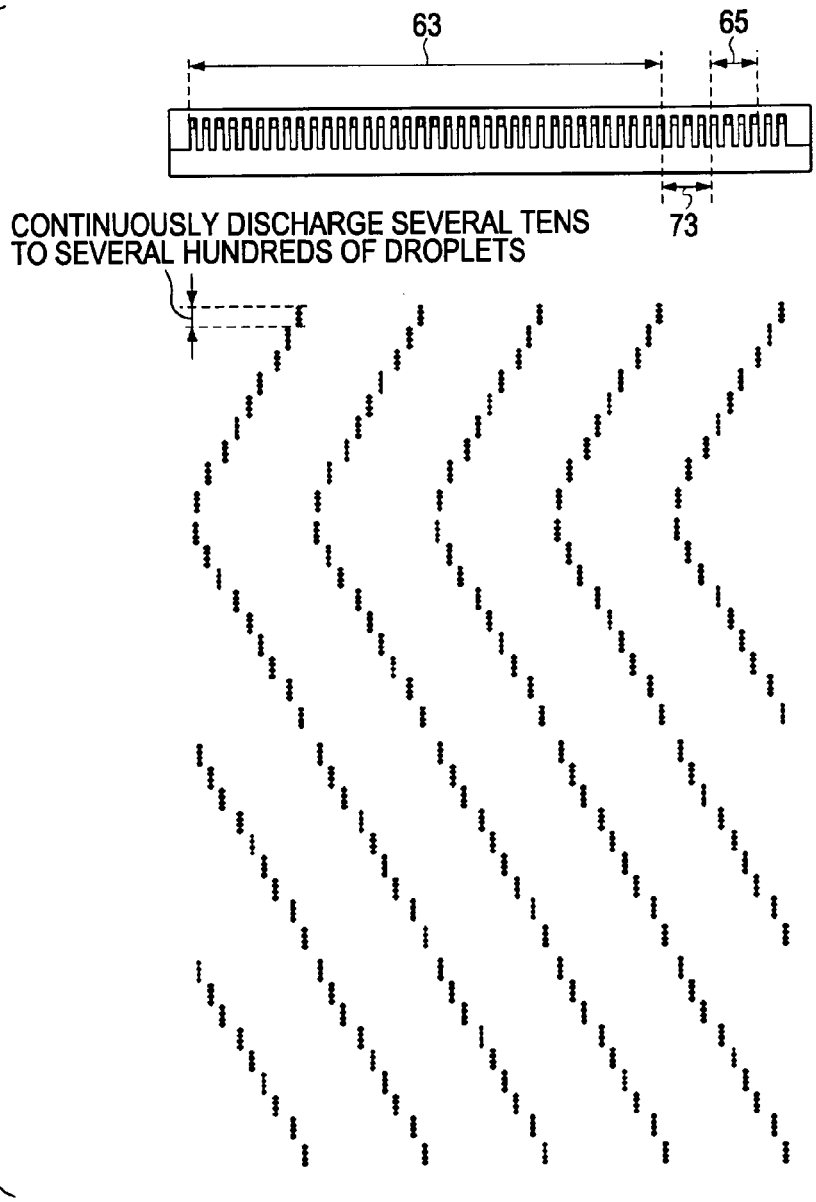
FIG. 13 shows another example of a driving manner of the print head.
Figure 14:
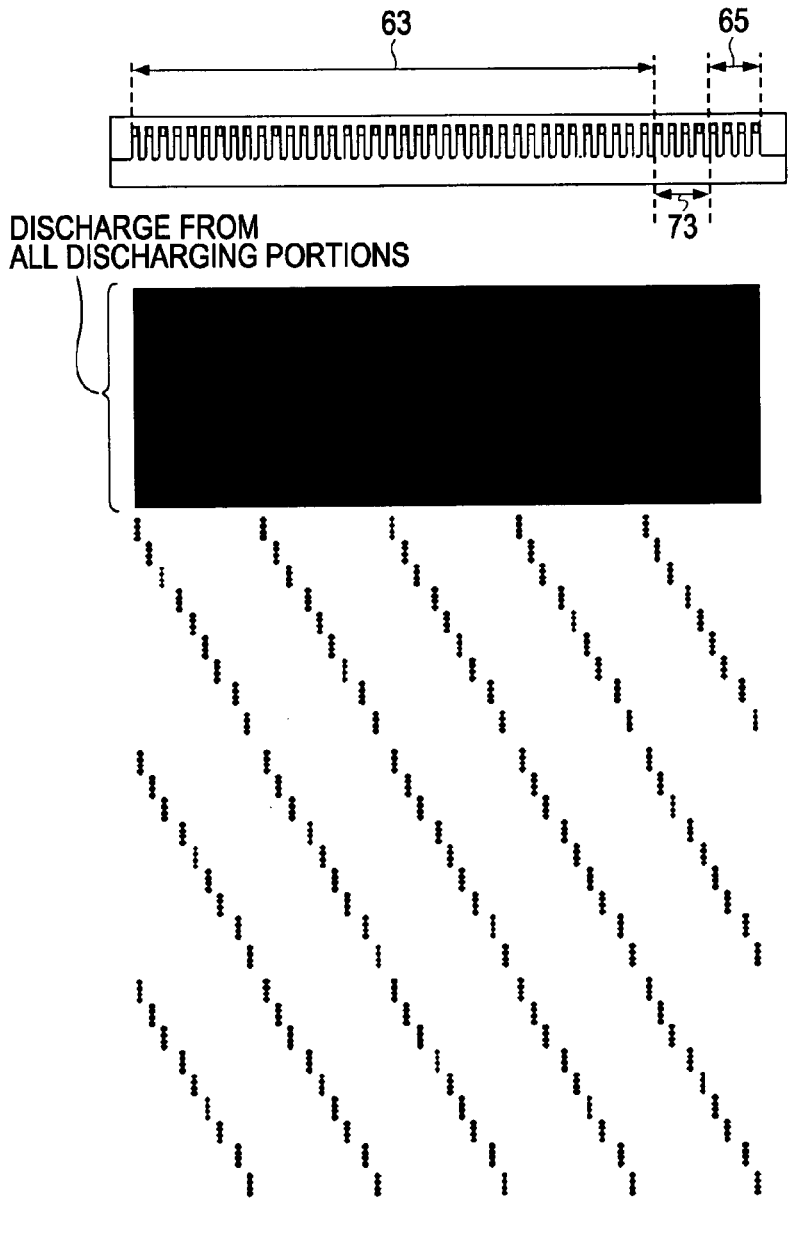
FIG. 14 shows a further example of a driving manner of the print head.

In this case, as shown in FIG. 13, the continuous discharging positions are shifted in a direction opposite the foreign-substance trap region 65, and are then shifted one by one toward the foreign-substance trap region 65. Alternatively, as shown in FIG. 14, ink droplets are discharged from all discharging portions, and the continuous discharging positions are then shifted one by one toward the foreign-substance trap region 65.

This combination with the operation of shifting the continuous discharging position in the direction opposite the original direction or the operation of discharging from all discharging portions can improve mobility of the foreign substance.

(v) Fifth Specific Example

Figure 15:
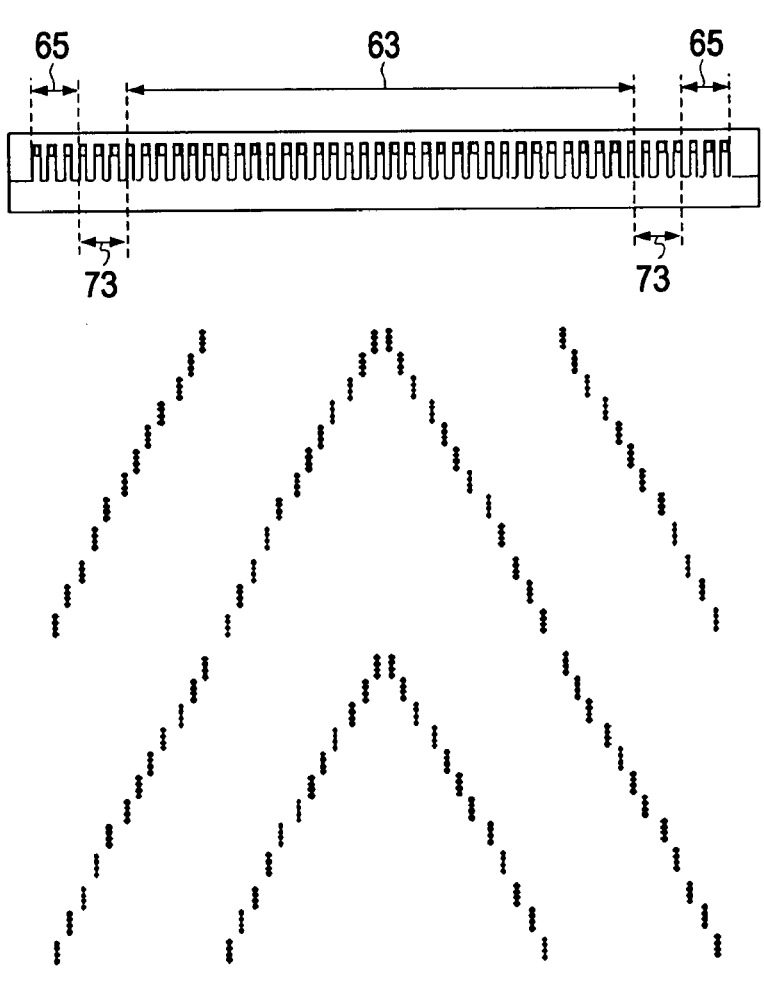
FIG. 15 shows a further example of a driving manner of the print head.

When the foreign-substance trap region 65 is provided at each end of the print head, the continuous discharging positions can be shifted so that the foreign substance 23 moves toward both ends of the print head, as shown in FIG. 15. In other words, the continuous discharging positions can be shifted one by one from almost the center of the print head to the right and left.

In this case, the operation of continuously discharging ink droplets may be simultaneously started from a plurality of positions arranged so that several discharging portions are provided therebetween, as shown in FIG. 15. Driving is controlled so that the continuous discharging positions are shifted one by one from the center to the right end of the print head in an area on the right side of the center, and so that the continuous discharging position are shifted one by one from the center to the left end of the print head in an area on the left side of the center.

In the driving method shown in FIG. 15, if a foreign substance 23 exists in a discharging portion 1 near the center of the print head, it is conceivable that the foreign substance 23 will not easily move, since it is drawn to both the right and left ends by the continuous discharging operation.

Figure 16:
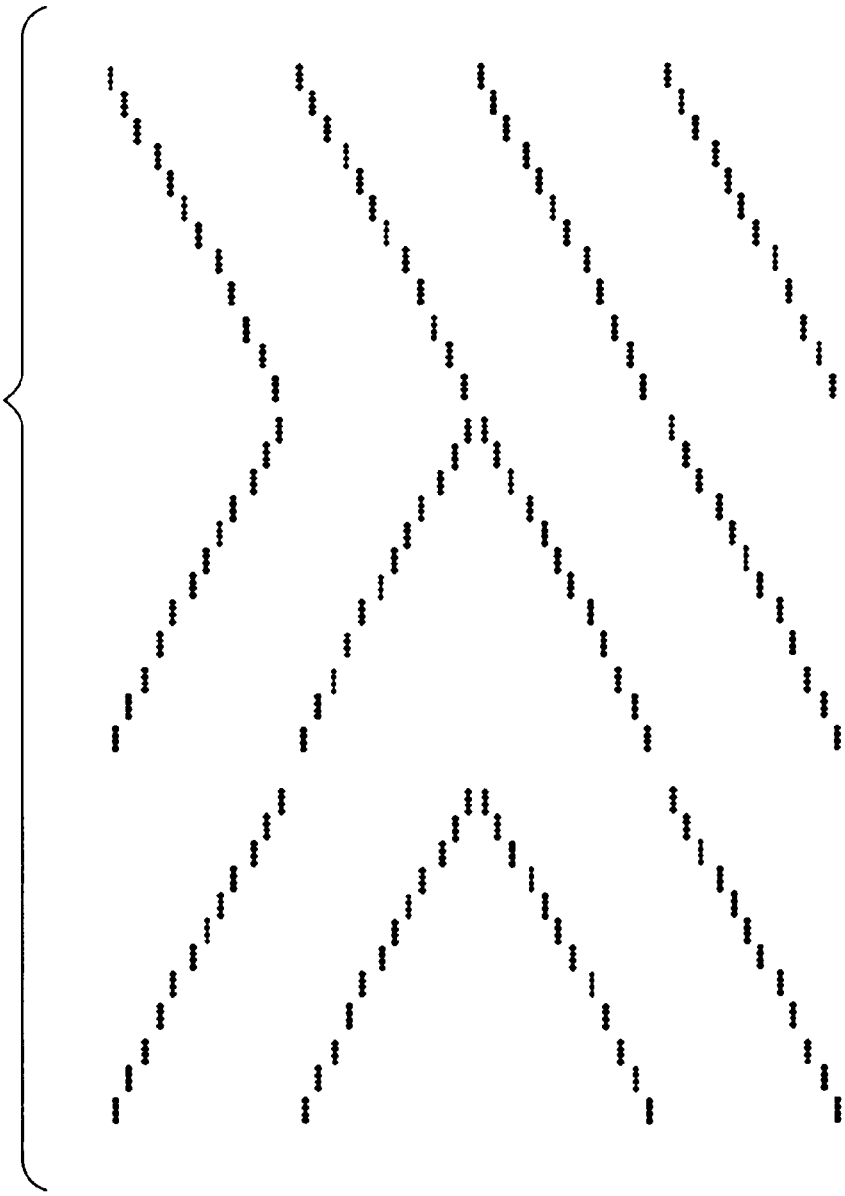
FIG. 16 shows a further example of a driving manner of the print head.

In this case, as shown in FIG. 16, the continuous discharging positions are first shifted in one of the right and left directions so as to slightly move the foreign substance 23, and are then shifted from the center to the right and left ends of the print head.

(vi) Sixth Specific Example

In the above-described methods of driving the discharging portions, the foreign substance 23 can be reliably trapped in the foreign-substance trap region 65 by repeating driving several times before printing. As a result, the fear that the foreign substance will adversely affect printing can be removed. However, this takes too much time before printing.

Accordingly, the continuous discharging operation may be fully performed only during cleaning performed when a discharging defect is found in a print result or at power-on, and may be performed only several times during idle discharging before normal printing.

In continuous discharging operation performed for each printing, the foreign substance 23 that is going to return from the foreign-substance trap region 65 to the print region 63 is pushed back to the foreign-substance trap region 65 by reducing the number of discharging operations and the number of repeated cycles (one cycle corresponds to driving from the start position to the end of the print head). This can reduce the continuous discharging time before printing.

(vii) Seventh Specific Example

Figure 17:
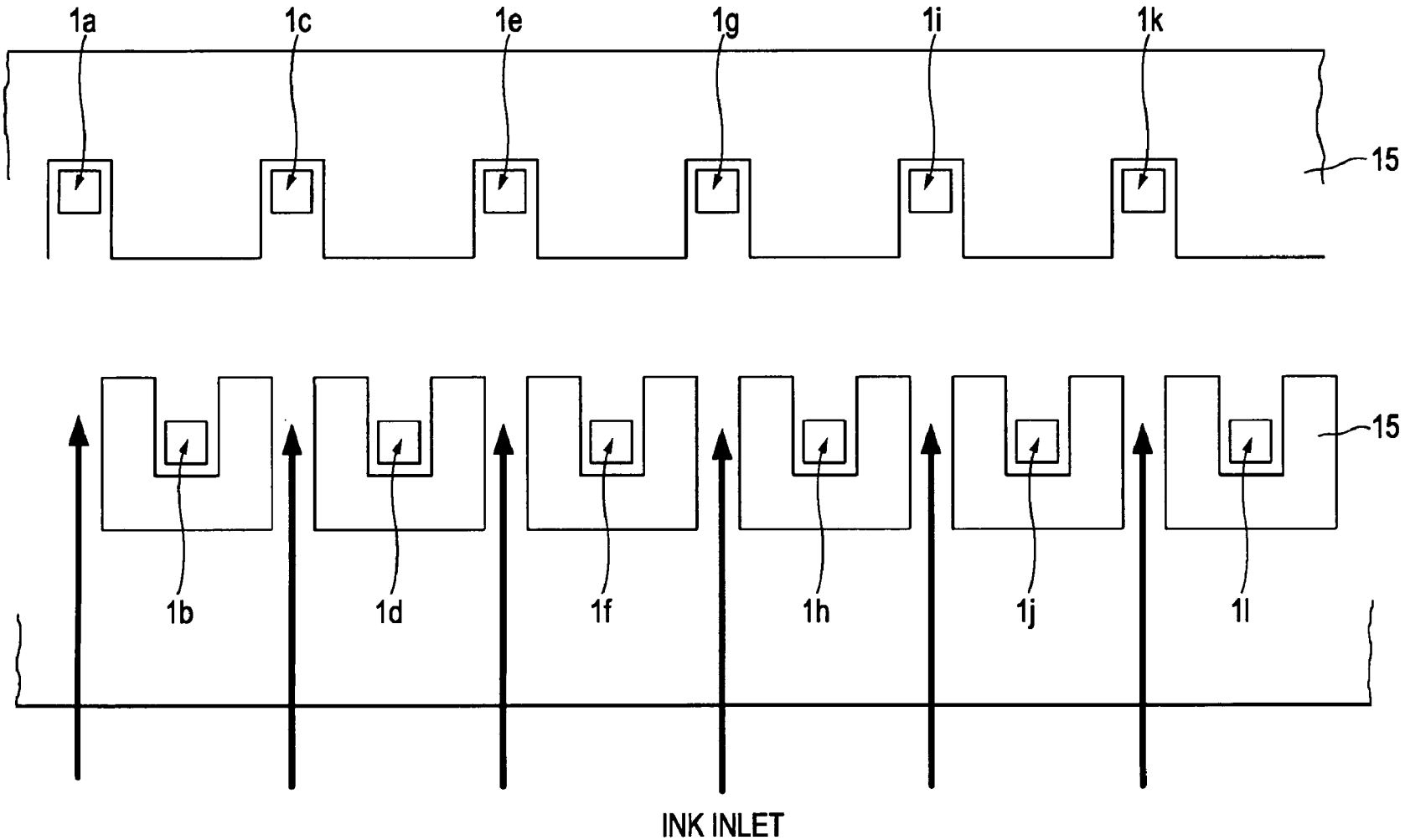
FIG. 17 shows a further example of a print head.

FIG. 17 shows a seventh specific example of a print head. In a print head shown in FIG. 17, openings on one side of a liquid chamber 13 oppose openings on the other side so as to be shifted from each other by half pitch in the arrangement direction of the discharging portions.

By thus arranging the discharging portions 1 in a zigzag so as to oppose each other across the ink channel, the foreign substance can be moved more smoothly.

Figure 18:
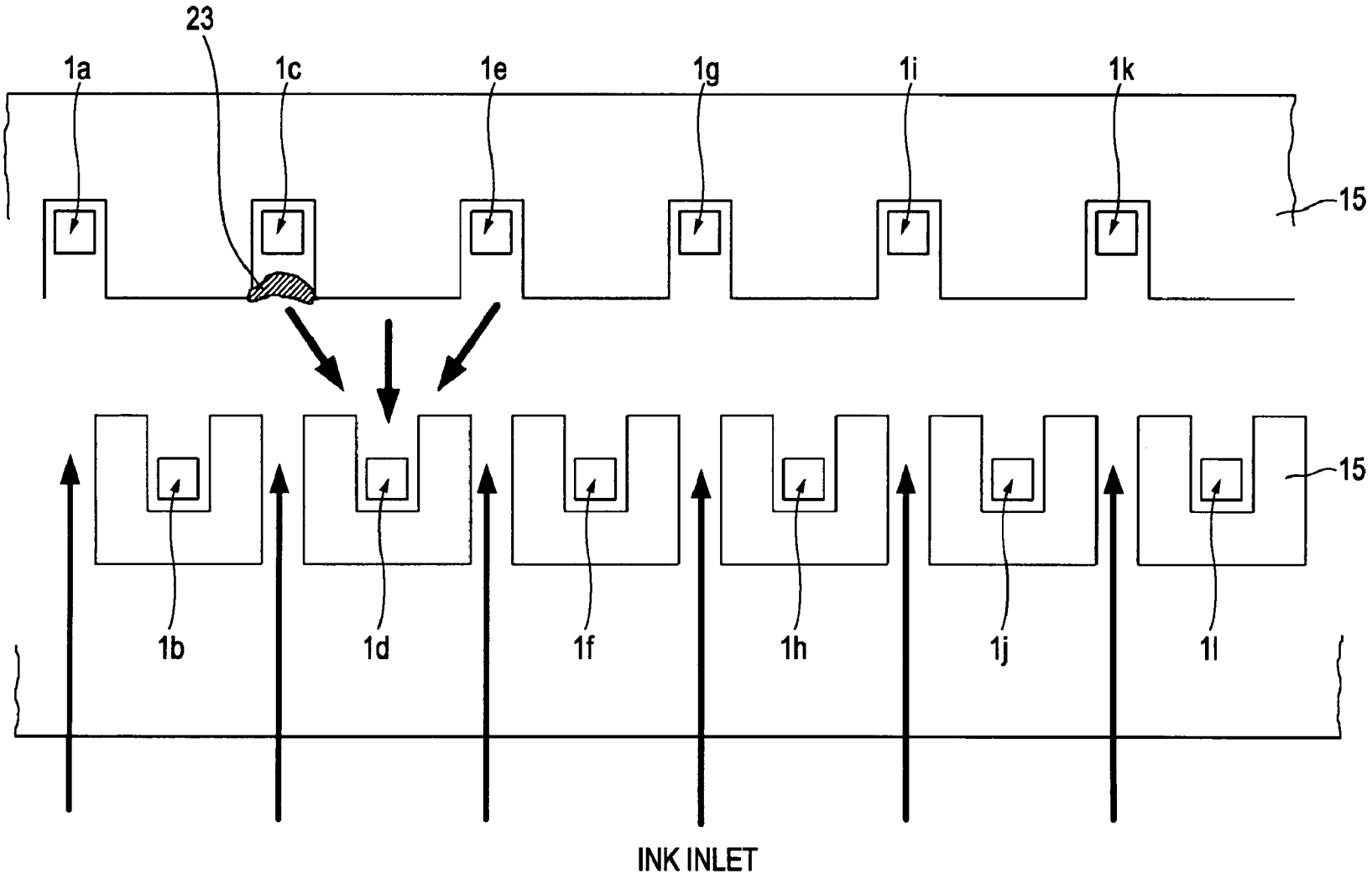
FIG. 18 explains the principle that a foreign substance moves in the print head shown in FIG. 17.

When several tens to several hundreds of ink droplets are continuously discharged from a discharging portion 1*d* in a state in which a foreign substance 23 exists in a discharging portion 1*c*, as shown in FIG. 18, the foreign substance 23 can be diagonally moved so as to be drawn to the discharging portion 1*d* by flows of refilled ink.

Figure 5:
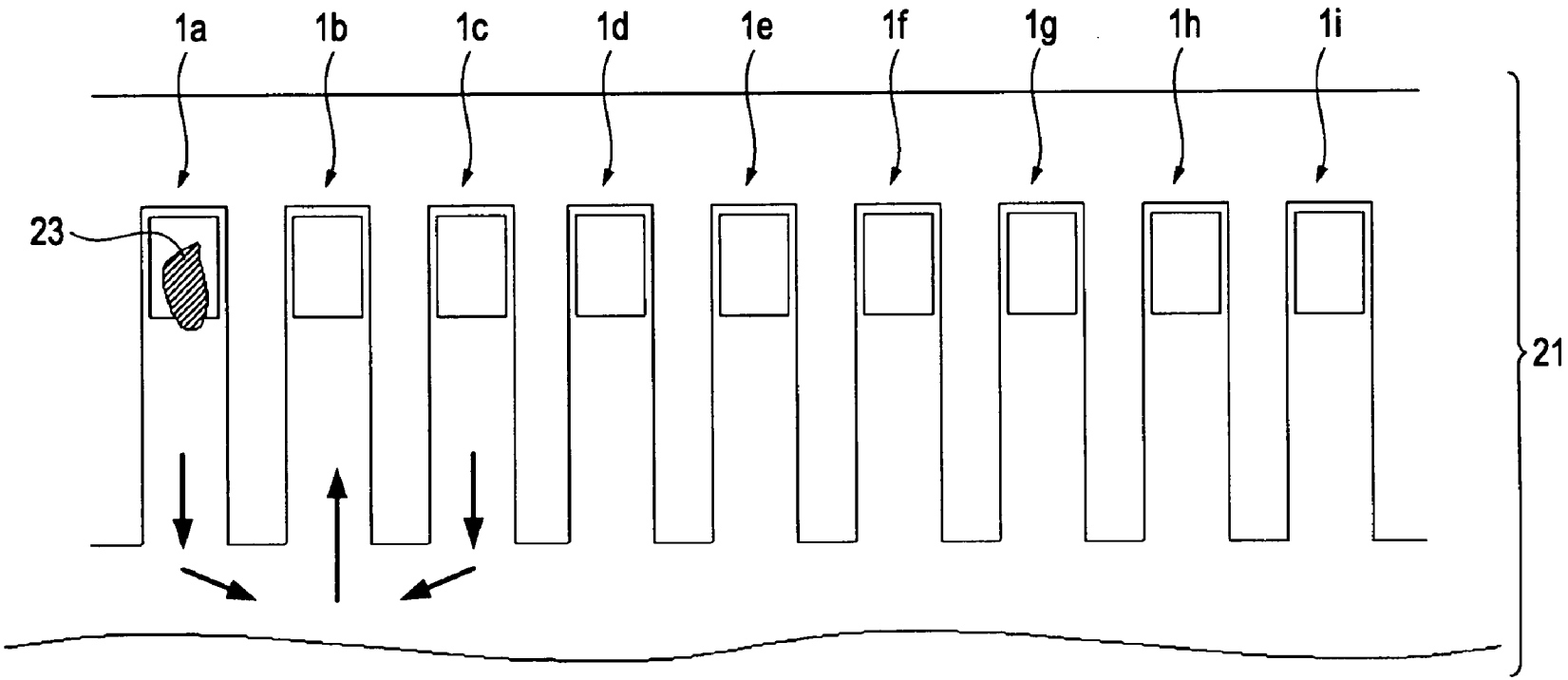
FIG. 5 explains the movement of a foreign substance by a proposed continuous discharging operation.

In this case, the influence of the discharging portion 1*d* on the discharging portion 1*c* more linearly acts in the structure shown in FIG. 18 than in the structure shown in FIG. 5. For this reason, it is very easy to move the foreign substance 23.

Next, when several tens to several hundreds of ink droplets are continuously discharged from a discharging portion 1*e*, ink is also going to be drawn from the adjacent discharging portion 1*d* into the discharging portion 1*e*. As a result, the foreign substance 23 moves from the discharging portion 1*d* to the discharging portion 1*e*. Subsequently, when the continuous discharging position for ink droplets is shifted to the discharging portions 1*f*, 1*g*, 1*h*, 1*i*, . . . in order, the foreign substance 23 can also be moved to the discharging portions 1*f*, 1*g*, 1*h*, 1*i*, . . . . By printing an image only with the print region 63 in this state, high-quality printing can be achieved without any influence of the foreign substance.

(viii) Eighth Specific Example

Figure 19A:
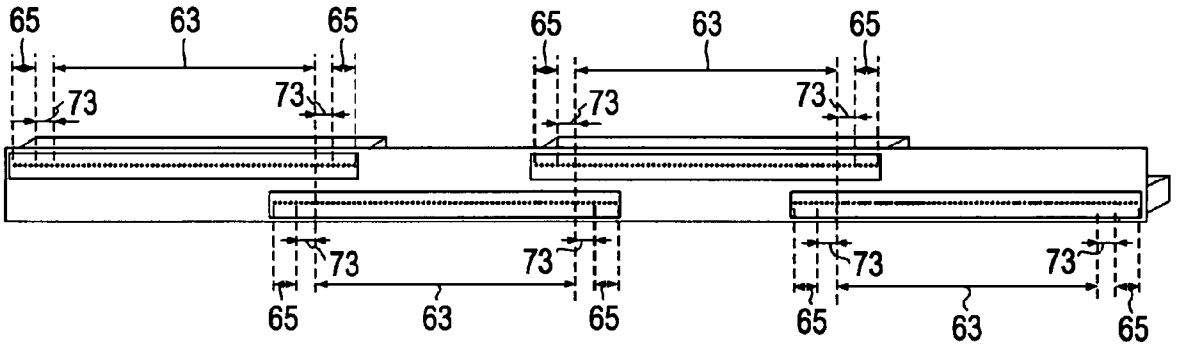
FIG. 19 shows a further example of a print head.
Figure 19B:
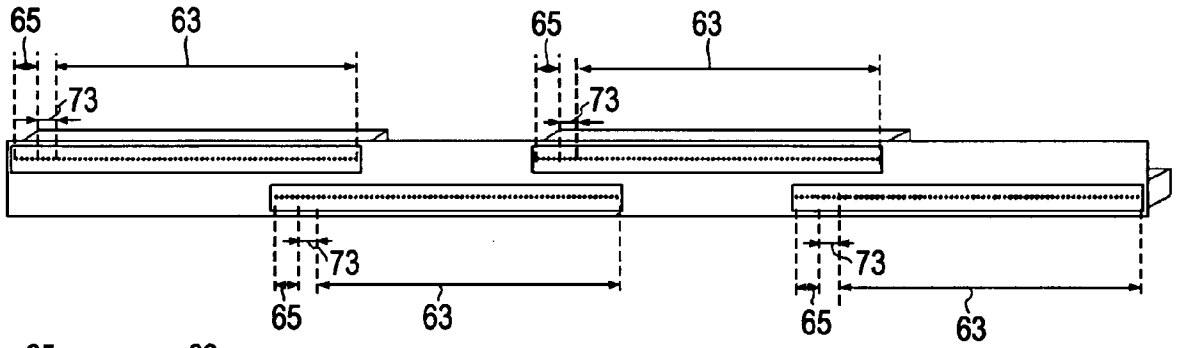
Figure 19C:
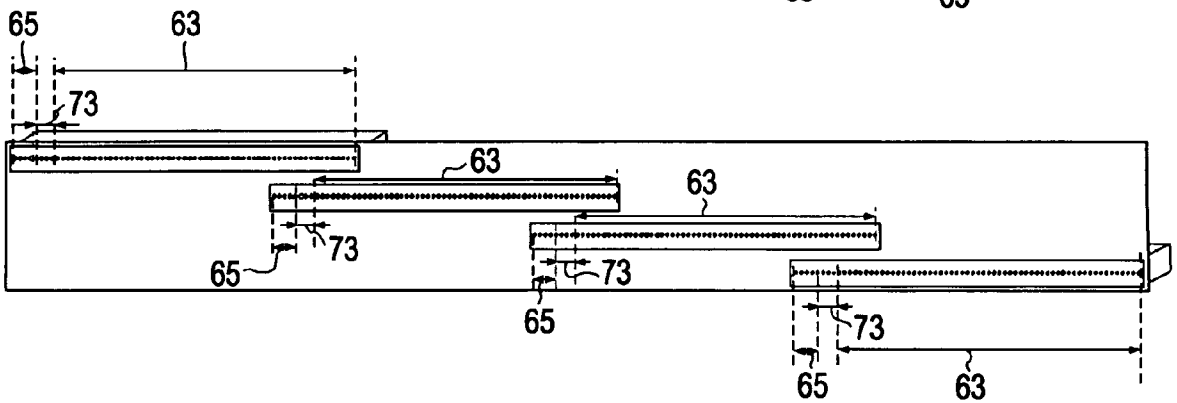

FIGS. 19A to 19C show a print head structure according to an eighth specific example in which one long head is formed by combining a plurality of small heads in the longitudinal direction. In this case, a foreign-substance trap region 65 and a barrier region 73 are prepared for each small head.

FIG. 19A shows a case in which a foreign-substance trap region 65 and a barrier region 73 are provided on each side of each small head.

FIG. 19B shows a case in which a foreign-substance trap region 65 and a barrier region 73 are provided on one side of each small head.

Of course, the barrier region 73 may be omitted.

Print regions 63 of the small heads can be arranged so as not to overlap, as shown in FIG. 19A, or so as to overlap in areas each corresponding to several discharging portions, as shown in FIG. 19B.

Instead of being arranged in a zigzag, as shown in FIGS. 19A and 19B, the small heads can be arranged in a stepwise pattern, as shown in FIG. 19C, or units, in each of which three small heads are arranged in a stepwise pattern, can be arranged repeatedly, although not shown. The small heads can be arranged in other various patterns.

A-3: Advantages

By adopting the above-described continuous discharging methods, a foreign substance or bubble in the print head can be moved and removed from the discharging portions 1 that constitute the print region 63.

Further, discharging portions that are normally not used for printing are provided at the end of the print head, and continuous discharging operation is repeated so as to continuously drive one discharging portion and to then continuously drive the next discharging portion. This allows the foreign substance or bubble in the print head to move to the region of the discharging portions that are normally not used for printing.

Consequently, the foreign substance or bubble can be removed from the discharging portions used for printing. In other words, it is possible to realize a print without causing undischarging or curved discharging due to the foreign substance and bubble in the print head.

One or more discharging portions that are not used for printing (buffer region 73) are provided between the foreign-substance trap region 65 and the print region 63. Therefore, the foreign substance or bubble in the foreign-substance trap region 65 can be prevented from being drawn back to the print region 65 by the ink flow formed during printing.

By repeating continuous discharging operation during idle discharging before printing, a foreign substance or bubble that has accidentally entered near the liquid chamber in the previous printing operation can be moved to the foreign-substance trap region 65, and a foreign substance or bubble that is going to be drawn back from the foreign-substance trap region 65 to the print region 63 can be moved into the foreign-substance trap region 65 again. Consequently, it is possible to prevent undischarging or curved discharging from being caused by the foreign substance and bubble in the print head.

By arranging the discharging portions in a zigzag with respect to the ink channel and arranging the openings of the liquid chamber so as to oppose each other, a foreign substance or bubble can be moved easily. Consequently, the foreign substance or bubble can be moved to the foreign-substance trap region 65 with a small number of discharged droplets.

B: OTHER EMBODIMENTS

B-1: Application Example

In the above-described embodiment of the present invention, the driving method is applied to the inkjet printer.

However, the driving method can be applied to any apparatus that discharges droplets from nozzles. For example, the present invention is also applicable to an apparatus that discharges droplets of liquid formed of a mixture of an organic material, an inorganic material, and a metal material.

B-2: Others

Various modifications of the above-described embodiment can be made within the scope of the present invention. Further, various modifications and applications can be created or combined on the basis of the description of the specification.

What is claimed is:

1. A maintenance method for an ink discharging head in which multiple discharging portions are arranged in a line, the method comprising:

performing an operation of sequentially discharging droplets from a plurality of adjacent discharging portions in a predetermined direction toward a region of the discharging head which does not generate printed data at a side thereof.

2. The maintenance method according to claim 1, wherein the predetermined direction is a direction extending from one end to the other end of the discharging head.

3. The maintenance method according to claim 1, wherein the predetermined direction is a rightward direction in a right region of the discharging head and is a leftward direction in a left region of the discharging head.

4. The maintenance method according to claim 1, further comprising:

sequentially performing discharging in a direction opposite the predetermined direction for a short period before sequentially discharging in the predetermined direction.

5. The maintenance method according to claim 1, wherein the maintenance method is performed before every printing operation.

6. The maintenance method according to claim 1, wherein the predetermined direction is a direction extending from a discharging region in which the discharging portions used for printing are arranged to a trap region in which the discharging portions that are not used for printing are arranged.

7. The maintenance method according to claim 1, wherein openings of a liquid chamber corresponding to the discharging portions in the discharging head are arranged in a zigzag so as to oppose across a liquid channel.

8. The maintenance method for an ink discharging head in which multiple discharging portions are arranged in line according to claim 1, wherein a plurality of ink ejecting portions substantially simultaneously eject ink before the sequential ink ejection operation toward a region of the discharging head which does not generate printed data at a side thereof.

9. A maintenance device for a discharging head in which multiple discharging portions are arranged in a line, wherein the maintenance device controls a head driving unit during a maintenance operation for the discharging head so as to perform an operation of sequentially discharging in a predetermined direction toward a region of the discharging head which does not generate printed data at a side thereof.

10. A droplet discharging apparatus comprising:

a discharging head in which multiple discharging portions are arranged in a line;

a head driving unit configured to drive the discharging head;

a maintenance unit configured to perform an operation of sequentially discharging droplets in a predetermined direction toward a region of the discharging head which does not generate printed data at a side thereof.

11. A discharging head comprising:

multiple discharging portions arranged in a line;

a discharging region in which discharging portions used for printing are arranged; and a trap region in which discharging portions that are not used for printing are arranged at a side of the discharging head, the trap region being provided at one end or both ends of the discharging region, and configured to trap a foreign substance or a bubble moved by performing an operation of sequentially discharging droplets from in a predetermined direction toward a region of the discharging head which does not generate printed data at a side thereof.

12. The discharging head according to claim 11, wherein at least one discharging portion is provided between the discharging region and the trap region so as to prevent backflow of the foreign substance or the bubble into the discharging region.

13. The discharging head according to claim 11, wherein openings of a liquid chamber corresponding to the discharging portions in the discharging region and the trap region are arranged in a zigzag so as to oppose across a liquid channel.

14. A computer program stored in an electronic memory of a microprocessor controlled system for causing maintenance operation of an ink discharging head in which multiple discharging portions are arranged in a line, wherein execution of the computer program instructions causes the microprocessor controlled system to perform:

the sequential discharge of droplets from discharging portions in a predetermined direction toward a region of the discharging head which does not generate printed data at a side thereof.

15. The discharging head according to claim 11, wherein a plurality of ink ejecting portions substantially simultaneously eject ink before the sequential ink ejection operation toward a region of the discharging head which does not generate printed data at a side thereof.

* * * * *